US005551268A

United States Patent [19]

Carnes et al.

[11] Patent Number: 5,551,268

[45] Date of Patent: Sep. 3, 1996

[54] RETAINER ASSEMBLY FOR A LOCK CYLINDER

[75] Inventors: Vince S. Carnes, White Lake; Javier Saldana, Pontiac, both of Mich.

[73] Assignee: Chrysler Corporation, Highland Park, Mich.

[21] Appl. No.: 415,282

[22] Filed: Apr. 3, 1995

[51] Int. Cl.[6] ..... E05B 9/08

[52] U.S. Cl. ..... 70/370; 70/451; 70/DIG. 49; 70/418; 70/367

[58] Field of Search ..... 70/416, 417, 370, 70/418, 451, DIG. 15, DIG. 49, 367, 422, 379 R, 448, 449; 292/DIG. 38; 248/27.1

[56] References Cited

U.S. PATENT DOCUMENTS

| | | | |
|---|---|---|---|
| 2,312,643 | 3/1943 | Hoettels | 70/370 |
| 2,443,362 | 6/1948 | Tinnerman | 70/370 |
| 2,506,642 | 5/1950 | Jacobi | 180/90 |
| 2,549,724 | 4/1951 | Tinnerman | 70/370 |
| 2,610,500 | 9/1952 | Poupitch | 70/370 |
| 2,744,185 | 5/1956 | Cawley | 240/2 |
| 2,938,373 | 5/1960 | Gray | 70/86 |
| 2,948,141 | 8/1960 | Vahlstrom | 70/370 |
| 3,287,944 | 11/1966 | Crumb | 70/419 |
| 3,868,836 | 3/1975 | LaRoche | 70/240 |
| 4,099,397 | 7/1978 | Dauenbaugh | 70/371 |
| 4,381,656 | 5/1983 | Hayakawa | 70/451 |
| 4,492,101 | 1/1985 | Tanaka | 70/370 |
| 4,726,206 | 2/1988 | Hsu | 70/DIG. 49 |
| 4,756,638 | 7/1988 | Neyret | 403/261 |
| 4,765,165 | 8/1988 | O'Gara | 70/417 |
| 4,852,373 | 8/1989 | McGough | 70/417 |
| 4,873,852 | 10/1989 | Neyret | 70/451 |
| 4,983,947 | 1/1991 | Mullen et al. | 70/DIG. 49 |

FOREIGN PATENT DOCUMENTS

| | | | |
|---|---|---|---|
| 390669 | 10/1990 | European Pat. Off. | 70/370 |
| 2360727 | 3/1978 | France | 70/451 |

*Primary Examiner*—Darnell M. Boucher
*Attorney, Agent, or Firm*—G. Andrew Barger

[57] ABSTRACT

A retainer assembly for attaching a lock cylinder to a door panel, the lock cylinder having a length and a plurality of radially spaced flanges disposed on and raised outwardly therefrom. The retainer assembly comprises a retainer clip having at least two laterally spaced apart flanges, the at least two laterally spaced apart flanges preventing rotational movement of the lock cylinder when the lock cylinder is engaged with the retainer clip. A base is provided having a first side, a second side, and an open-ended slot. The base is connected to the retainer clip at the second side. The open-ended slot is provided for slidingly engaging the lock cylinder such that upon engagement of the lock cylinder, the base flatly abuts against the door panel on the first side and the retainer clip abuts against the plurality of radially spaced flanges of the lock cylinder. The base has a height equaling at least half of the length of the lock cylinder and a width equaling at least the length of the lock cylinder to prevent disengagement of an anti-theft device that is engaged with the lock cylinder.

11 Claims, 2 Drawing Sheets

RETAINER ASSEMBLY FOR A LOCK CYLINDER

BACKGROUND OF THE INVENTION

1. Field of the Invention

The present invention relates, generally, to the art of retainer assemblies. In particular, the present invention relates to a retainer assembly for attaching a lock cylinder to a vehicle door panel.

2. Description of the Related Art

Vehicle manufacturers have long been faced with the problem of attaching a lock cylinder to a door panel. The lock cylinder must partially extend outside of the door panel to allow for the easy insertion of a key into a lock cylinder facing by a vehicle operator, and must also partially extend inside of the door panel so that it may be attached to the door panel via one or more retainer assemblies. In the past, vehicle manufacturers have produced retainer assemblies that are very thin in relation to the longitudinal length of the lock cylinder. Such retainers typically have two prongs that engage flanges disposed on the lock cylinder. This arrangement prevents the cylinder from being pulled out of the door panel. The diameter of the lock cylinder face is larger than the diameter of the aperture provided in the door panel and this prevents the lock cylinder from being pushed into the door panel. Current retainer clips have prongs that bow in convex fashion away from the door panel. Since the prongs do not fully engage the door panel, dimpling can occur where the cylinder face, washer, and door panel meet. This creates an aesthetically unattractive appearance on the outside of the vehicle door panel.

In addition, the typical thin retainer assemblies have a small bending moment, thus creating possible instances whereby the lock cylinder may be forced out of the aperture in the door panel via rotational forces being asserted on the lock cylinder. Such forces may break the thin prongs of the retainer assembly. Moreover, with enough force, the lock cylinder can be pulled or pried out of the body aperture wherein it is disposed; and allow access to the vehicle interior.

A further disadvantage with past retainer assemblies is that they are typically made of steel or other corrosive metals. A lock cylinder that is not properly sealed to the door panel may allow for the introduction of environmental elements such as water and salt to come into contact with the metal retainer assembly. This has the undesirable consequence of allowing for corrosion of the retainer assembly and thereby further weakening the holding force exerted on the lock cylinder by the retainer assembly.

A still further disadvantage in the prior art is that wide flanges are not provided at the base of the retainer clip to further prevent theft situations such as where a thief pierces the door panel with a sharp instrument and disengages an anti-theft device that may be in contact with the lock cylinder. Moreover, current anti-theft devices that are deactivated when the lock cylinder is turned, fail to provide a means for preventing deactivation of the anti-theft device.

SUMMARY OF THE INVENTION

In light of such desirable characteristics, not fully present in the related art, the present invention provides a retainer assembly for attaching a lock cylinder to a vehicle door panel. The retainer assembly comprising a retainer clip having at least two laterally spaced apart flanges, the at least two laterally spaced apart flanges preventing rotational movement of the lock cylinder when the lock cylinder is engaged with the retainer clip and a base having a first end, a second end, and an open-ended slot, the base being connected to the retainer clip at the second end.

The open-ended slot for slidingly engaging the lock cylinder such that upon engagement of the lock cylinder, the base flatly abuts against the vehicle door panel at the first end and the retainer clip abuts against the plurality of radially spaced flanges of the lock cylinder. The base having a height equaling at least half of the longitudinal length of the lock cylinder and a width equaling at least the longitudinal length of the lock cylinder.

Other objects, features and advantages of the present invention will become apparent by reference to the following detailed description when considered in conjunction with the accompanying drawings.

BRIEF DESCRIPTION OF THE DRAWINGS

In the drawings below, reference characters refer to like parts throughout the views, and wherein.

DESCRIPTION OF THE PREFERRED EMBODIMENT(S)

Figure 1:
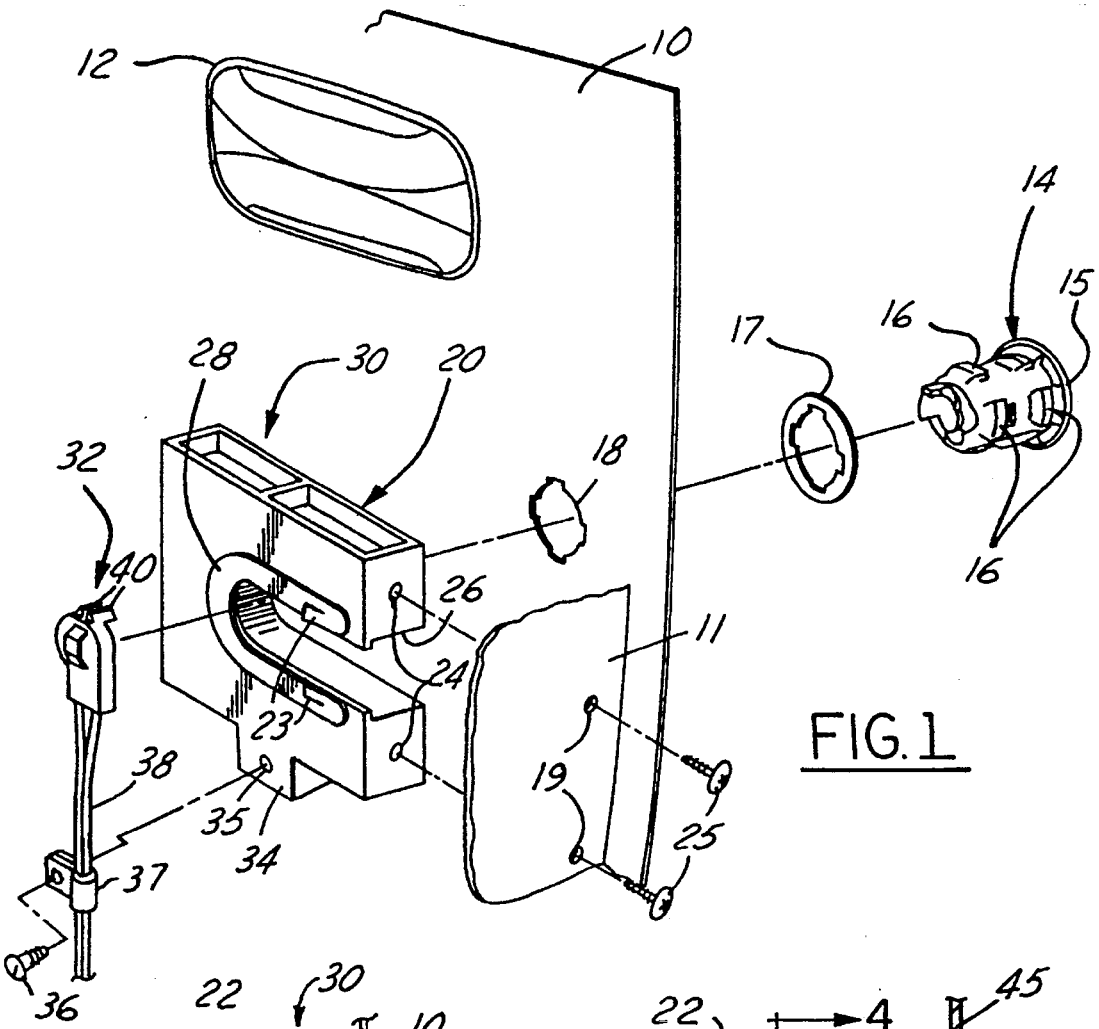
FIG. 1 is an exploded view of the retainer assembly of the present invention.

Commencing with FIG. 1, a door panel 10 is shown. The door panel 10 has a handle 12 disposed therein and is in contact with a side panel 11. The door panel 10 and side panel 11 form a planar right angle. The side panel 11 has side panel apertures 19 for receiving base screws 25 therein. The door panel 10 further has an aperture 18 for slidingly receiving a lock cylinder 14. The lock cylinder 14 is elongated and has a lock cylinder facing 15 at the other end thereof. The lock cylinder facing 15 has a key hole (not shown) disposed therein and extending longitudinally into the lock cylinder 14 for the insertion of a key by a vehicle operator. The lock cylinder 14 further includes a plurality of radially spaced lock cylinder flanges 16 disposed on the lock cylinder 14. A washer 17 is also provided that is disposed between the door panel 10 and the lock cylinder facing 15.

Figure 2:
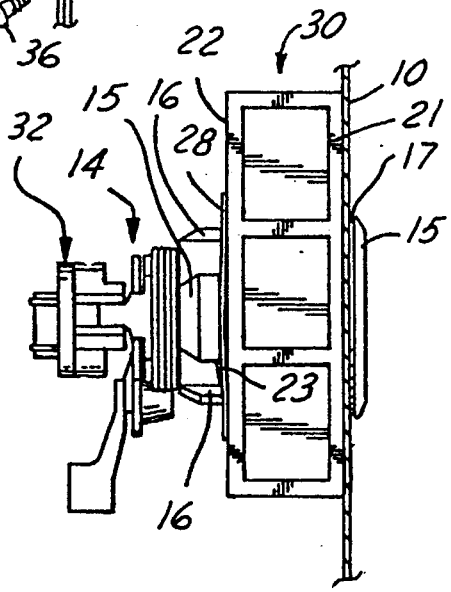
FIG. 2 is a plan view of the retainer assembly of the present invention.

A retainer assembly 30 is provided for attaching the lock cylinder 14 to the door panel 10 and side panel 11 once the lock cylinder 14 is inserted through the door panel aperture 18. The retainer assembly 30 comprises a substantially solid, integrally formed, U-shaped base 20 that is preferably fabricated of a plastic material but can be of any resilient material. The plastic is impervious to corrosion when environmental elements such as water and salt come in contact with the base 20. The base 20 has a first side 21 and a second side 22 as shown in FIG. 2. The base 20 further has a height equaling at least half of the longitudinal length of the lock cylinder 14 and a width equaling at least the longitudinal length of the lock cylinder 14. The base 20 also includes base retention apertures 24 so that the base 20 can be attached or screwed to the side panel 11 via base screws 25 that are inserted through side panel apertures 19. In the preferred embodiment the base 20 is block-shaped and an anti-theft device is included that is connected to the lock cylinder 14.

As shown in FIG. 1, the retainer assembly 30 further includes a slot 26. The slot 26 is provided for slidingly engaging the lock cylinder 14 after the lock cylinder 14 has been inserted into the door panel aperture 18. In the preferred embodiment, the slot 26 defines the U-shape of the base 20 while it is understood that other slot shapes may be employed that also have the function of allowing the retainer assembly 30 to slidingly engage the lock cylinder 14. The retainer assembly 30 further comprises a retainer clip 28. The retainer clip 28 is connected to the second side 22 of base 20 and abuts against the lock cylinder flanges 16 when the base 20 is engaged with the lock cylinder 14. The retainer clip 28 is preferably U-shaped but could also take the form of other geometric shapes in accordance with the type of shape employed for slot 26. The retainer clip 28 has at least two laterally spaced apart flanges 23 projecting away from the second side 22 of base 20.

Figure 3:
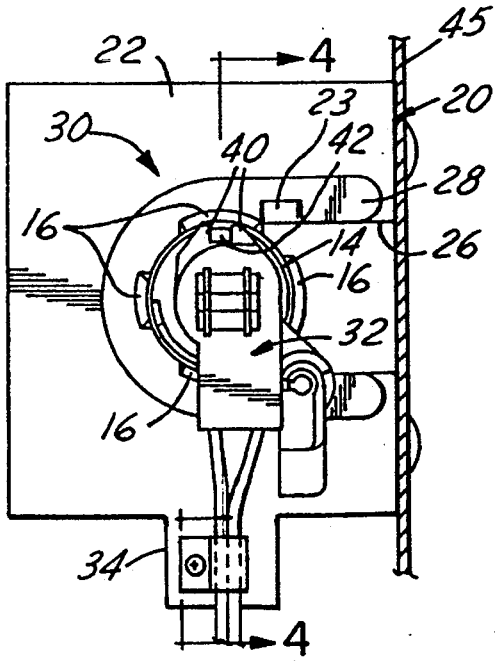
FIG. 3 is a rear view of the retainer assembly of the present invention.

An anti-theft device 32 is provided for engagement with the lock cylinder 14. The anti-theft device 32 generally takes the form a stem. As shown in FIG. 3, the anti-theft device 32 has laterally spaced apart prongs 40 that grasp a flange 42 disposed on the lock cylinder 14 so that the device 32 cannot be rotated by external forces other than a key turning internal mechanisms within the lock cylinder 14. The anti-theft device 32 is electrically operated and has electrical wires 38 connected thereto for providing a supply of current to the anti-theft device 32. An anti-theft retention receptacle 34 is provided for attaching the electrical wires 30 to the base 20. The retention receptacle 34 includes an aperture 35 for receiving a screw 36 or similar attachment device. The screw 36 being inserted through a bracket 37. Attachment of the electrical wires 30 to the base 20 prevents disengagement of the anti-theft device 32 from the lock cylinder 14 if an instrument is inserted into the body panel 10 and also prevents rotation on the lock cylinder 14.

In operation, the anti-theft device 32 is normally activated if the device 32 is dislodged from the lock cylinder 14. If, however, a vehicle operator inserts and turns a key within the lock cylinder 14, the anti-theft device 32 will be deactivated. Once deactivated, the vehicle operator or a thief can gain entrance to the interior of the vehicle.

Referring now to FIG. 2, the lock cylinder 14 is shown inserted into the door panel aperture 18 (not shown). The first side 21 of the base 20 abuts flatly against the door panel 10 while the retainer clip 28 abuts against the lock cylinder flanges 16. The anti-theft device 32 is in engagement with the lock cylinder 14. The relatively large height and width of the base provides a high bending moment of the magnitude of 50 ft/lbs such that the lock cylinder 14 cannot be manipulated, or forcibly removed from the door panel 10 via inward, outward, or rotational forces being asserted on the lock cylinder 14. The relatively large width of the base also performs the function of preventing intrusion into the door panel 10 at a point near the door panel aperture 18 while the large height of the base 20 prevents an instrument from coming in contact with the anti-theft device 32 if the instrument is inserted into the door panel 10 at a point that is distant from the door panel aperture 18.

Referring now to FIG. 3, the retainer assembly 30 is shown attaching the lock cylinder 14 to the door panel 10, while the anti-theft device 32 is shown connected to the lock cylinder 14. The base 20 is attached to the side panel 11 via base screws 25 that are inserted into base retention apertures 24.

Figure 4:
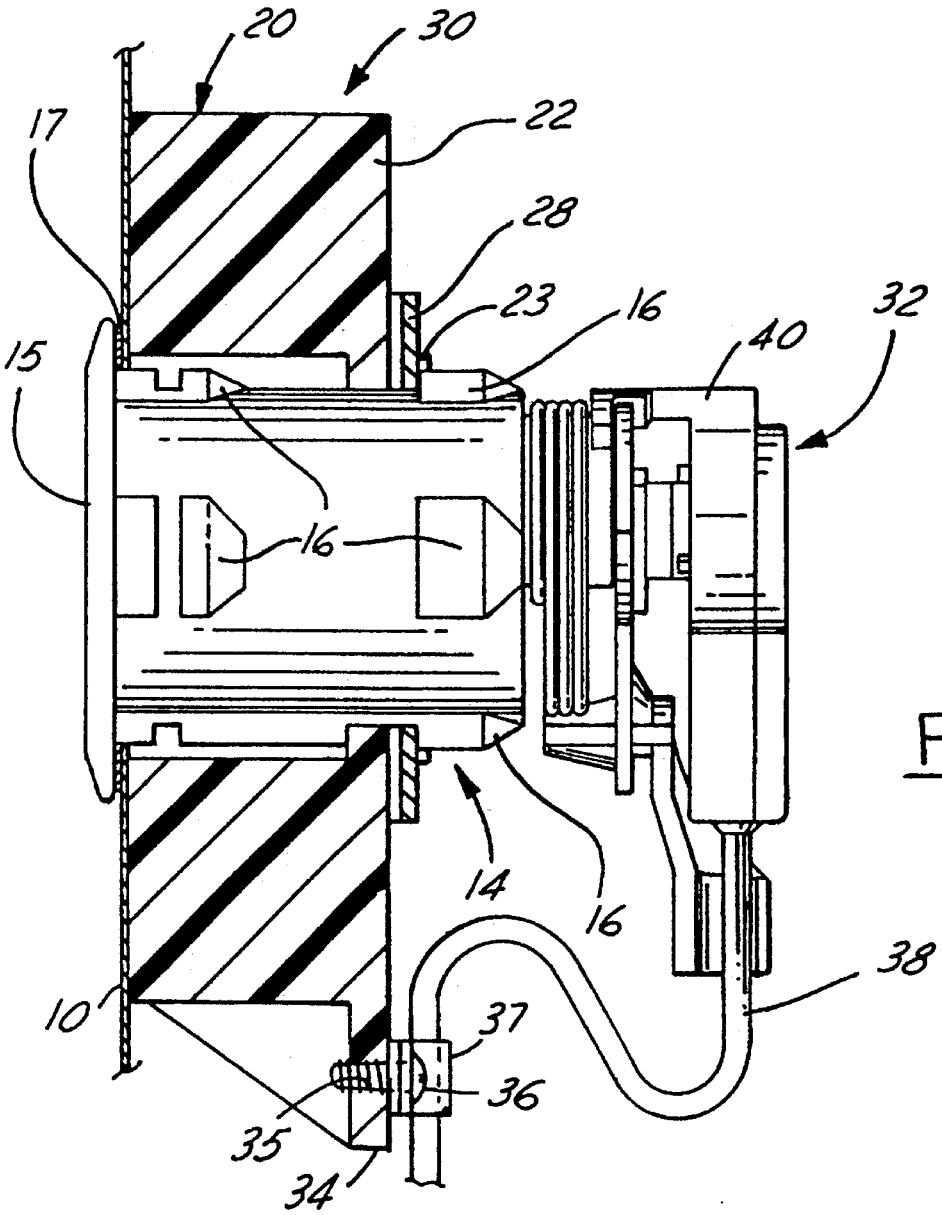
FIG. 4 is a cross sectional view of the retainer assembly of the present invention taken substantially along the line 4—4 of FIG. 3.

Referring now to FIG. 4, a cross sectional view of the retainer assembly 30 is shown. The lock cylinder facing 15 abuts the washer 17 which in turn abuts the door panel 10. The lock cylinder facing 15 has a diameter that is substantially larger than the diameter of the door panel aperture 18. As best shown in FIGS. 3 and 4, the retainer clip flanges 23 abut two of the radially spaced lock cylinder flanges 16, thereby preventing rotational movement of the lock cylinder 14 within the door panel aperture 18.

While the invention has been described in detail, it is to be expressly understood that it will be apparent to persons skilled in the relevant art that the invention may be modified without departing from the spirit of the invention. Various changes of form, design or arrangement may be made to the invention without departing from the spirit and scope of the invention. Therefore, the above mentioned description is to be considered exemplary, rather than limiting, and the true scope of the invention is that defined in the following claims.

What is claimed is:

1. A retainer assembly for attaching a lock cylinder to a door panel, the lock cylinder being partially disposed within a door panel aperture, elongated, and having a plurality of radially spaced flanges disposed thereon and raised outwardly therefrom, the retainer assembly comprising:

an anti-theft device engaged with the lock cylinder;

a U-shaped retainer clip having at least two laterally spaced apart flanges, the at least two laterally spaced apart flanges engaging two of the lock cylinder flanges and preventing lateral movement of the lock cylinder when the lock cylinder is engaged with the U-shaped retainer clip;

a base having a first side, a second side, and an open-ended slot, the base being connected to the U-shaped retainer clip at the second side, the open-ended slot providing sliding engagement of the lock cylinder with the base such that upon engagement of the lock cylinder the first side of the base flatly abuts against the door panel thereby preventing dimpling on the body panel, the U-shaped retainer clip abuts against the plurality of radially spaced flanges of the lock cylinder thereby preventing rotation of the lock cylinder when partially disposed within the door panel aperture, the base having a width and a height equaling at least half of the length of the lock cylinder thereby preventing the lock cylinder from being forcibly removed from the door panel; and means for preventing disengagement of the anti-theft device with the lock cylinder, the means for preventing disengagement of the anti-theft device connected to the base.

2. The retainer assembly of claim 1 wherein the means for preventing disengagement of the anti-theft device with the lock cylinder comprises the base having a width equaling at least the length of the lock cylinder thereby preventing disengagement of the anti-theft device from the lock cylinder upon insertion of an instrument into the door panel at a point in lateral proximity to the door panel aperture.

3. The retainer assembly of claim 2 wherein the means for preventing disengagement of the anti-theft device with the lock cylinder further comprises the base having a height equaling at least half of the length of the lock cylinder thereby preventing disengagement of the anti-theft device from the lock cylinder upon insertion of an instrument into the door panel at a point distal to the door panel aperture.

4. The retainer assembly of claim 3 wherein the U-shaped retainer clip is integrally formed with the base.

5. The retainer assembly of claim 4 wherein the base is attached to a side panel by at least one screw that is inserted through the side panel and the base.

6. The retainer assembly of claim 5 wherein the means for preventing disengagement of the anti-theft device with the lock cylinder is integrally formed with the base.

7. A retainer assembly for attaching a lock cylinder to a door panel, the lock cylinder being partially disposed within a door panel aperture, elongated, and having a plurality of radially spaced flanges disposed thereon and raised outwardly therefrom, the retainer assembly comprising:

an anti-theft device engaged with the lock cylinder;

a U-shaped retainer clip having at least two laterally spaced apart flanges, the at least two laterally spaced apart flanges engaging two of the lock cylinder flanges and preventing lateral movement of the lock cylinder when the lock cylinder is engaged with the U-shaped retainer clip;

a substantially solid, integrally formed, base having a first side, a second side, and an open-ended slot, the base being connected to the U-shaped retainer clip at the second side, the open-ended slot providing sliding engagement of the lock cylinder with the base such that upon engagement of the lock cylinder the first side of the base flatly abuts against the door panel thereby preventing dimpling on the body panel, the U-shaped retainer clip abuts against the plurality of radially spaced flanges of the lock cylinder thereby preventing rotation of the lock cylinder when partially disposed within the door panel aperture, the base having a width equaling at least the length of the lock cylinder thereby preventing disengagement of the anti-theft device from the lock cylinder upon insertion of an instrument into the door panel at a point that is in lateral proximity to the door panel aperture, and the base having a height equaling at least half of the length of the lock cylinder thereby preventing disengagement of the anti-theft device from the lock cylinder upon insertion of an instrument into the door panel at a point distal to the door panel aperture;

means for preventing disengagement of the anti-theft device with the lock cylinder, the means for preventing disengagement of the anti-theft device connected to the base; and whereby the height and the width of the base provide a bending moment of approximately 50 ft/lbs thereby preventing the lock cylinder from being forcibly removed from the door panel.

8. The retainer assembly of claim 7 wherein the U-shaped retainer clip is integrally formed with the block-shaped base.

9. The retainer assembly of claim 8 wherein the anti-theft device is attached to the block-shaped base.

10. The retainer assembly of claim 9 wherein the base is attached to a side panel by at least one screw that is inserted through the side panel and the base.

11. The retainer assembly of claim 8 wherein the means for preventing disengagement of the anti-theft device with the lock cylinder comprises the base having a width equaling at least the length of the lock cylinder thereby preventing disengagement of the anti-theft device from the lock cylinder upon insertion of an instrument into the door panel at a point in lateral proximity to the door panel aperture.

* * * * *